US011274873B2

(12) United States Patent
Stahl

(10) Patent No.: US 11,274,873 B2
(45) Date of Patent: Mar. 15, 2022

(54) DOMESTIC REFRIGERATION APPLIANCE DEVICE

(71) Applicant: BSH HAUSGERAETE GMBH, Munich (DE)

(72) Inventor: Robert Stahl, Herbrechtingen (DE)

(73) Assignee: BSH Hausgeraete GmbH, Munich (DE)

( * ) Notice: Subject to any disclaimer, the term of this patent is extended or adjusted under 35 U.S.C. 154(b) by 682 days.

(21) Appl. No.: 15/532,864

(22) PCT Filed: Nov. 25, 2015

(86) PCT No.: PCT/EP2015/077650
§ 371 (c)(1),
(2) Date: Jun. 2, 2017

(87) PCT Pub. No.: WO2016/091590
PCT Pub. Date: Jun. 16, 2016

(65) Prior Publication Data

US 2017/0328628 A1 Nov. 16, 2017

(30) Foreign Application Priority Data

Dec. 9, 2014 (DE) ..... 10 2014 225 196.6

(51) Int. Cl.
*F25D 21/04* (2006.01)
*F25D 11/00* (2006.01)
(Continued)

(52) U.S. Cl.
CPC ..... *F25D 23/062* (2013.01); *F25D 11/00* (2013.01); *F25D 21/04* (2013.01); *F25D 23/063* (2013.01);
(Continued)

(58) Field of Classification Search
CPC ..... F25D 23/062; F25D 11/00; F25D 21/04; F25D 23/065; F25D 23/066; F25D 11/02;
(Continued)

(56) References Cited

U.S. PATENT DOCUMENTS 2,460,469 A * 2/1949 Rifkin ..... F25D 21/04 62/275
2,703,442 A * 3/1955 Philipp ..... F25D 23/02 312/405
(Continued)

FOREIGN PATENT DOCUMENTS

CN 102927740 A 2/2013
DE 102009028789 A1 2/2011
(Continued)

OTHER PUBLICATIONS

Translation of Japanese Patent Document JP 2009156478 A entitled Translation—JP 2009156478 A (Year: 2020).*

*Primary Examiner* — Paul Alvare
(74) *Attorney, Agent, or Firm* — Laurence A. Greenberg; Werner H. Stemer; Ralph E. Locher

(57) ABSTRACT

A domestic refrigeration appliance device, in particular a domestic freezer appliance device, includes a frame unit provided for at least partially delimiting an access opening. The frame unit includes at least one frame sub-element having at least one groove running at least substantially parallel to a main direction of extension of the frame sub-element. In order to improve reliability, the frame sub-element has at least two cross-sectional shapes differing substantially from one another in a subregion relative to the main direction of extension. A domestic refrigeration appliance, in particular a domestic freezer appliance, and a method for manufacturing a domestic refrigeration appliance device, in particular a domestic freezer appliance device, are also provided.

14 Claims, 4 Drawing Sheets

(51) Int. Cl.
*F25D 23/02* (2006.01)
*F25D 21/08* (2006.01)
*F25D 23/06* (2006.01)
*F25D 21/12* (2006.01)

(52) U.S. Cl.
CPC ..... *F25D 23/065* (2013.01); *F25D 23/066* (2013.01); *F25D 21/08* (2013.01); *F25D 21/12* (2013.01); *F25D 23/02* (2013.01)

(58) Field of Classification Search
CPC ..... F25D 2400/06; F25D 21/08; F25D 21/12; F25D 21/125; F25D 23/061
See application file for complete search history.

(56) References Cited

U.S. PATENT DOCUMENTS 2,807,942 A * 10/1957 Dahlgren ..... F25D 21/04 62/130
2,858,408 A * 10/1958 Barroero ..... F25D 23/021 49/70
3,038,319 A * 6/1962 Kesling ..... F25D 23/082 62/275
3,157,306 A * 11/1964 Courson ..... F25D 21/04 312/405
3,254,503 A * 6/1966 Rundell ..... F25D 21/04 62/275
3,440,308 A * 4/1969 Carbary ..... F25D 23/064 220/592.1
3,858,409 A * 1/1975 Besing ..... F25D 23/082 62/285
3,984,223 A * 10/1976 Whistler, Jr. ..... F25D 21/04 62/81
4,114,065 A * 9/1978 Horvay ..... F25D 21/04 220/592.1
4,150,518 A * 4/1979 Truesdell ..... F25D 21/04 220/592.08
4,474,017 A * 10/1984 Prada ..... F25D 21/04 29/437
4,485,639 A * 12/1984 Sakamoto ..... F25D 21/04 62/505
4,550,576 A * 11/1985 Tate, Jr. ..... F25D 23/069 62/441
4,586,348 A * 5/1986 Nakayama ..... F25D 21/04 220/592.1
4,606,112 A * 8/1986 Jenkins ..... F25D 23/062 29/464
4,821,399 A * 4/1989 Markley ..... B29C 44/18 264/46.5
4,855,567 A * 8/1989 Mueller ..... F25D 21/04 219/218
4,950,869 A * 8/1990 Mueller ..... F25D 21/04 219/213
5,349,832 A * 9/1994 Johnson ..... E05D 5/06 312/407
5,992,960 A * 11/1999 Wolanin ..... F25D 21/04 312/265.5
6,178,763 B1 1/2001 Brancheau et al.
6,393,855 B1 * 5/2002 Schuchert ..... F25D 21/04 62/275
7,407,240 B2 * 8/2008 Collins ..... F25D 23/063 312/406.2
8,979,224 B2 3/2015 Jang et al.
9,243,835 B2 1/2016 Jeon et al.
9,920,975 B2 * 3/2018 Kim ..... F25D 23/061
9,970,701 B2 * 5/2018 Cho ..... F25D 21/04
10,429,121 B2 * 10/2019 Yoon ..... F25D 23/028
2012/0102985 A1 * 5/2012 Tafoya ..... F25D 21/04 62/81

FOREIGN PATENT DOCUMENTS

DE 102012209659 A1 12/2012
EP 2596309 A2 5/2013
ES 2385804 A1 8/2012
JP H02133785 A 5/1990
JP 2009156478 A * 7/2009
JP 2009156478 A 7/2009
KR 20080088751 A 10/2008
WO 2012010455 A2 1/2012

* cited by examiner

DOMESTIC REFRIGERATION APPLIANCE DEVICE

BACKGROUND OF THE INVENTION

Field of the Invention

The invention relates to a domestic refrigeration appliance device, in particular a domestic freezer appliance device, including a frame unit for at least partially delimiting an access opening, the frame unit having at least one frame sub-element, and at least one groove running at least substantially parallel to a main direction of extension of the frame sub-element. The invention moreover relates to a method for manufacturing a domestic refrigeration appliance device, in particular a domestic freezer appliance device, which includes providing a frame unit delimiting an access opening, providing the frame unit with at least one frame sub-element, and introducing at least one groove running at least substantially parallel to a main direction of extension of the frame sub-element into the frame sub-element.

A domestic refrigeration appliance which has a groove that runs in a frame sub-element and serves to receive a heating element is already known from the German patent application DE 10 2009 028 789 A1.

SUMMARY OF THE INVENTION

The object of the invention consists in particular in providing a generic device with improved properties in respect of reliability. The object is achieved by providing the frame sub-element with at least two cross-sectional shapes which differ substantially from one another in a subregion in relation to the main direction of extension, while advantageous embodiments and developments of the invention can be taken from the subclaims.

The invention is based on a domestic refrigeration appliance device, in particular a domestic freezer appliance device, having a frame unit which is provided for delimiting an access opening at least partially, preferably for at least the most part, and particularly preferably completely, and which has at least one frame sub-element which comprises at least one groove running at least substantially parallel to a main direction of extension of the frame sub-element.

It is proposed that the frame sub-element, in particular in respect of the main direction of extension, has at least two significantly different cross-sectional shapes in a subregion thereof. A "domestic refrigeration appliance device" in this context is to be understood in particular to mean at least one part, in particular a sub-assembly, of a domestic refrigeration appliance. In particular, the domestic refrigeration appliance device can also comprise the entire domestic refrigeration appliance. The domestic refrigeration appliance can be embodied here as any domestic refrigeration appliance which appears to be useful to the person skilled in the art, in particular as a domestic refrigerator and/or preferably domestic freezer, such as in particular a refrigerator, deep freezer, upright freezer, chest freezer, fridge-freezer and/or wine storage cabinet. In particular, the domestic refrigeration appliance device comprises at least one appliance body, which in particular defines a usable space, in particular at least one refrigerating zone and in particular has an access opening. Furthermore, the domestic refrigeration appliance device comprises in particular at least one appliance closure element, which can be embodied in particular as an appliance flap and/or preferably as an appliance door and can be mounted in particular pivotably about a pivot axis, in particular about a horizontal axis and/or about a vertical axis, in particular with respect to a set-up position and/or an installation position, in particular in relation to the appliance body. A "frame unit" is to be understood in particular as a unit, which preferably embodies a frame and encompasses and/or comprises in particular the access opening at least partially, preferably for at least the most part and particularly preferably completely. The fact that "a first object is encompassed and/or comprised at least partially by a second object" is to be understood in particular to mean that in at least one assembled state at least one beam coming from a center of mass of the second object exists, said beam, after passing through at least one subregion of the first object, once again running through at least one subregion of the second object. The expression "for at least the most part" is to be understood here in particular to mean at least 60%, advantageously at least 70%, preferably at least 80% and particularly preferably at least 90%. The frame unit is preferably part of an inner container of the appliance body and is preferably connected in one piece herewith. In particular the frame unit is formed from at least one frame sub-element. "Frame sub-element" is to be understood here to mean in particular one part and/or component of the frame unit, which surrounds the access opening at least partially. The frame sub-element is preferably embodied in one piece with the frame unit and/or the inner container. In particular, the frame sub-element consists at least partially, preferably for at the least the most part and particularly preferably completely of a plastic, preferably of a thermoplastic and/or elastic plastic. "One piece" is in particular to be understood to mean connected at least with a material bonding, for instance by means of a welding process, an adhesion process, an injection process and/or another process which appears to be useful to the person skilled in the art, and/or advantageously molded in one piece, such as for instance by means of manufacturing from a cast iron and/or by manufacturing in a single or multi-component injection method and advantageously from a single blank. "Provided" is to be understood in particular to mean especially configured and/or equipped. The fact that an object is provided for a specific function is in particular to be understood to mean that the object fulfills and/or executes this specific function in at least one application and/or operating state. A "main direction of extension" of an object is in particular understood to mean a direction which runs at least substantially in parallel to a main extension of the object. A "main extension" of an object is in particular understood to mean a length of a longest edge of a smallest, in particular imaginary, cuboid which the object just, in particular completely, encloses. A "groove" is in particular to be understood to mean a region which corresponds in particular to a depression and/or recess of an object, and which is preferably provided to receive an object. A "subregion" of the frame sub-element, in particular relating to a main direction of extension of the frame sub-element, is in particular to be understood to mean a preferably oblong region, in particular of the frame sub-element, which is arranged at least substantially parallel to a, in particular precisely one, spatial direction and/or which extends at least substantially parallel in the spatial direction. In particular the subregion is arranged at least substantially parallel and/or at least substantially at right angles to a main direction of extension of the appliance body of the domestic appliance device. The subregion preferably comprises at least 50%, preferably 70% and particularly preferably 90% of the frame sub-element. The subregion preferably corresponds to a central region of the frame sub-element. The fact that an object is "oblong" is in particular to be understood to mean that a main extension of the object is at least twice, preferably at least five times, particularly preferably at least ten times as large as the width and/or height of the object. A "central region" is in particular to be understood to mean a region of the frame sub-element in which a geometric center point of the frame sub-element is arranged. A geometric center point of the central region is preferably substantially identical to the geometric center point of the frame sub-element. "At least substantially parallel" is to be understood to mean in particular an alignment of a direction in relation to a reference direction, in particular in a plane, wherein compared to the reference direction the direction has a deviation of in particular less than 8°, advantageously less than 5° and particularly advantageously less than 2°. The expression "substantially vertical" here is to define in particular an alignment of a direction in relation to a reference direction, wherein the direction and the reference direction, in particular viewed in a plane, has an angle of 90° and the angle has a maximum deviation of in particular less than 8°, advantageously less than 5° and particularly advantageously less than 2°. "Significantly different cross-sectional shapes" are to be understood in particular as cross-sectional shapes, the surfaces and/or contours, in particular cross-sectional surface contours of which, deviate from one another by in particular at least 10%, preferably by at least 20% and particularly preferably by at least 30%. In particular, the cross-sectional shapes have surfaces, in particular cross-sectional surfaces, which, projected onto an especially shared plane which is in particular at right angles to the main direction of extension, in the case of an especially best-possible intersection and/or overlapping of the surfaces, have a sectional surface and/or an overlapping of surfaces of at most 95%, preferably at most 85%, preferably at most 80% and particularly preferably at most 75% of the surface of one of the cross-sectional shapes. The surfaces, in particular cross-sectional surfaces, preferably have a surface content which is at least substantially the same. "A surface content which is at least substantially the same" is to be understood to mean in particular that the surface contents deviate from one another in particular by at most 2%, preferably by at most 5% and particularly preferably by at most 10%.

A domestic refrigeration appliance device which ensures an advantageous reliability can be provided by this embodiment. Furthermore a particularly stable frame sub-element can be provided by selecting different cross-sectional shapes. Moreover, a particularly advantageous locking effect, in particular for locking a component and/or functional element, advantageously heating element, can be achieved in particular by an advantageous embodiment of the groove. Here the component and/or functional element can be advantageously secured in particular against slipping with the aid of the frame sub-element, and held in a defined position in a tolerance non-critical manner in particular. The locking effect can be achieved on a section of the frame sub-element and/or on a large part of the frame unit. Furthermore, an adhesion of the component and/or functional element in the domestic refrigeration appliance can be improved. Moreover, a cost-neutral solution can be advantageously achieved, particularly without additional components and/or elements.

It is also proposed that at least two groove cross-sections at at least two at least substantially different positions are delimited by the cross-sectional shapes. A "groove cross-section" is in particular understood to mean a cross-section of the groove at right angles to the main direction of extension. The phrase "substantially at different positions" is in particular to be understood to mean that the groove cross-sections are displaced along the main direction of extension, in particular at a distance, which corresponds in particular at most to 1%, at most to 5% and particularly preferably at most to 10% of the main extension. This permits a simple manufacture of the groove of the frame sub-element.

Moreover, it is proposed that at least two groove cross-sections, delimited by the cross-sectional shapes, have an at least substantially identical shape. The fact that "two groove cross-sections have an at least substantially identical shape" is to be understood in particular to mean that the surfaces and/or contours of the two groove cross-sections deviate from one another by at most 15%, in particular by at most 25%, preferably by at most 35%. At least one mirror plane preferably exists, which is arranged preferably at right angles to a cross-sectional plane of at least one of the cross-sectional shapes and in which in particular the main direction of extension is arranged, which merges the groove cross-sections into one another. As a result, a particularly simple manufacture of the groove of the frame sub-element can be permitted.

Furthermore, it is proposed that the domestic refrigeration appliance device has at least one substantially oblong heating element, which is arranged on and preferably in the groove and is provided to counteract an icing of the frame unit at least partially, preferably for at least the most part and particularly preferably completely. In particular the heating element is provided to counteract an icing of at least one frame sub-element, in particular the appliance closure element and/or a sealing element, in particular appliance closure sealing element, at least partially, preferably for at least the most part and particularly preferably completely. A "heating element" is in particular to be understood to mean an element which is provided to generate heat energy, in particular by conversion from another energy form, preferably from chemical or electrical energy, from ambient heat and/or waste heat. In particular the heating element supplies the heat energy to an object, in particular to the appliance body, preferably the frame sub-element, preferably the appliance closure element and/or another element. In particular the heating element touches at least one wall delimiting the groove and in particular at least one wall of the frame sub-element. The heating element is preferably embodied to be at least substantially tubular, preferably as a heating pipe, particularly preferably as a heating gas pipe and is advantageously provided to receive and/or guide a heating fluid. An object embodied "to be at least substantially tubular" is to be understood to mean in particular an oblong object, preferably a hollow body, which has an opening preferably at at least one end and particularly advantageously at both ends. A "heating fluid" is in particular understood to mean a fluid, in particular a liquid and/or preferably a gas. Any fluid, such as hot gas, air, in particular ambient air and/or a refrigerant, for instance, which appears useful to the person skilled in the art can be used as a fluid here. By arranging the heating element within the frame sub-element, an icing, in particular a freezing of an appliance closure element and/or a sealing element, can be prevented. Moreover, the heating element can be arranged and preferably fastened advantageously securely within the groove.

Advantageously the domestic refrigeration appliance device comprises a fixing unit, which has the frame sub-element and at least one screen unit, which covers the groove at least partially, preferably for at least the most part and particularly preferably completely. The screen unit preferably has a sealing element contact surface, which, in particular together with the appliance closure element and a sealing element, in particular an appliance closure sealing element, is provided to close the access opening. The screen unit preferably has a preferably elastic frame strap, which, in an assembled state, encompasses the frame sub-element at least partially and preferably for at least the most part. In particular the frame strap is connected to the screen element and is preferably connected in one piece. In particular, the screen unit and/or the frame strap is/are formed by bending a sheet metal, preferably of an exterior housing of a domestic refrigeration appliance. An "elastic object" is in particular understood to mean an object which has at least one extension, which, in a normal operating state, can be elastically modified in particular by at least 5%, advantageously by at least 10%, preferably by at least 20% and particularly preferably by at least 30% and in particular by at most 60%, advantageously by at most 55%, preferably by at most 50% and in particular preferably by at most 45%. In particular the elastic object generates a counterforce which counteracts the change and is dependent on a change to the extension and is preferably proportional to the change. In particular the elastic object can be repeatedly deformed, especially without the object being mechanically damaged and/or destroyed in the process. Preferably the elastic object tends naturally to form a basic shape again, after a deformation. In particular the frame strap, in particular the screen unit, encompasses the groove in an at least substantially foam-tight manner. The fact that an object "encompasses the groove in an at least substantially foam-tight manner" is in particular to be understood to mean that the object is provided to prevent and/or block a flowing-out and/or preferably a penetration of a material, in particular a solid and/or preferably an at least partially liquid material, in a region of the further object up to at least 85%, advantageously at least 90%, preferably at least 95% and particularly preferably at least 99%. The groove and the heating element arranged therein can be arranged in a protected manner with the aid of the screen unit. In particular, a penetration of insulating foam, particularly during a manufacture of the domestic refrigeration appliance, can be prevented. This permits a safe and efficient mode of operation of the heating element.

Furthermore it is proposed that a projection of the heating element and of the fixing unit onto an in particular shared and preferably arbitrary plane at right angles to the main direction of extension has at least three, preferably precisely three, fixing regions between the heating element and the fixing unit. The screen unit preferably has at least one, preferably precisely one, fixing region and the frame sub-element has at least two, preferably precisely two, fixing regions. A "fixing region" is in particular understood to mean a region, in particular contact region, between at least two components, which is in particular embodied by a contact, preferably a press contact, of the components. In particular, the heating element is secured with force and/or form-locking by the fixing unit at least partially, preferably for at least the most part and particularly preferably completely. With the aid of the fixing regions the heating element can be secured within the groove, in particular against a slipping within the groove.

In one embodiment of the invention it is proposed that the cross-sectional shapes relating to the main direction of extension are arranged alternately at least in sections. In particular, the groove cross-sections preferably formed by the cross-sectional shapes are arranged and/or displaced in relation to one another alternately at least in sections. "Arranged alternately" is in particular to be understood to mean that sections of the different cross-sectional shapes and/or groove cross-sections follow one another alternately along the main direction of extension. In particular, a length of the sections can vary in particular spatially, in particular in the main direction of extension. The sections, in particular all sections, viewed in particular in the main direction of extension, preferably have a similar length. By means of an alternative arrangement, the heating element can intentionally be secured in critical regions.

In a further embodiment of the invention, it is proposed that the cross-sectional shapes relating to the main direction of extension are arranged periodically oscillating at least in sections. In particular, the groove cross-sections preferably formed by the cross-sectional shapes are arranged periodically oscillating at least in sections. "Arranged periodically oscillating" is in particular to be understood to mean that the sections of the different cross-sectional shapes and/or groove cross-sections follow one another alternately along the main direction of extension. The sections, in particular all sections, viewed in particular in the main direction of extension, preferably have the same length. In particular, the sections of different cross-sectional shapes and/or groove cross-sections repeat periodically. By means of a periodically oscillating arrangement, the heating element can on the one hand be intentionally secured in critical regions and on the other hand over the entire length of the subregion, in particular the central region, of the frame sub-element.

In a preferred embodiment of the invention, it is proposed that the cross-sectional shapes merge constantly into one another at least in sections. In particular, the groove cross-sections formed preferably by the cross-sectional shapes merge constantly into one another at least in sections. The fact that two objects "merge constantly into one another" is in particular to be understood to mean that their shape, contour and/or surfaces are constantly, in particular uniformly, preferably durably, particularly preferably continuously and in particular directly connected to one another and are preferably connected in one piece. A particularly stable frame sub-element can be provided by a constant merging of the sections.

In a further preferred embodiment of the invention, it is proposed that the frame sub-element and/or the groove, viewed in the main direction of extension, is configured at least substantially curved and/or angular at least in sections. The frame sub-element and/or the groove, viewed along the main direction of extension, is preferably configured in a sinusoidal, rectangular, triangular and/or sawtooth manner. At least one section of the frame sub-element and/or the groove preferably has at least one embodiment which deviates from the embodiment, in particular curved and/or angular embodiment, of a preceding section. By correspondingly selecting the embodiment, the groove and/or the frame sub-element can particularly preferably be adjusted to a shape of a heating element, which in particular has deviating shapes in different regions.

In a particularly preferred embodiment of the invention, it is proposed that the domestic refrigeration appliance device has at least one support element, which is provided to rest against the heating element and preferably to support and/or fix the heating element. The additional support element is preferably arranged within the groove and is preferably connected with the frame sub-element and is particularly preferably connected in one piece therewith. A locking effect can be further increased by the support elements.

The invention is further based on a method for manufacturing a domestic refrigeration appliance device, in particular a domestic freezer appliance device, having a frame unit, which is provided to delimit an access opening, and which has at least one frame sub-element, wherein at least one groove running at least substantially parallel to a main direction of extension of the frame sub-element is introduced into the frame sub-element.

It is proposed that the frame sub-element, in particular relating to the main direction of extension, in a subregion relating to the main direction of extension, is provided with at least two significantly different cross-sectional shapes. The frame sub-element is preferably manufactured by means of deep-drawing, preferably vacuum-drawing, a plastic, preferably thermoelastic plastic. A reliability, a locking effect and/or a stability of the domestic refrigeration appliance device can be improved in this way. Moreover, a cost-neutral method for manufacturing in particular any equipped frame sub-elements, can be provided in particular with production systems which are already available.

The domestic refrigeration appliance device is not to be restricted here to the afore-described application and embodiment. In particular, the domestic refrigeration appliance device can have a number which deviates from a number of individual elements, components and units, cited herein, in order to fulfill a mode of operation described herein.

BRIEF DESCRIPTION OF THE SEVERAL VIEWS OF THE DRAWING

Further advantages become apparent from the following description of the drawings. Exemplary embodiments of the invention are shown in the drawing. The drawing, the description and the claims contain numerous features in combination. The person skilled in the art will expediently also individually consider the features and combine them to form useful further combinations, in which:

DESCRIPTION OF THE INVENTION

Figure 1:
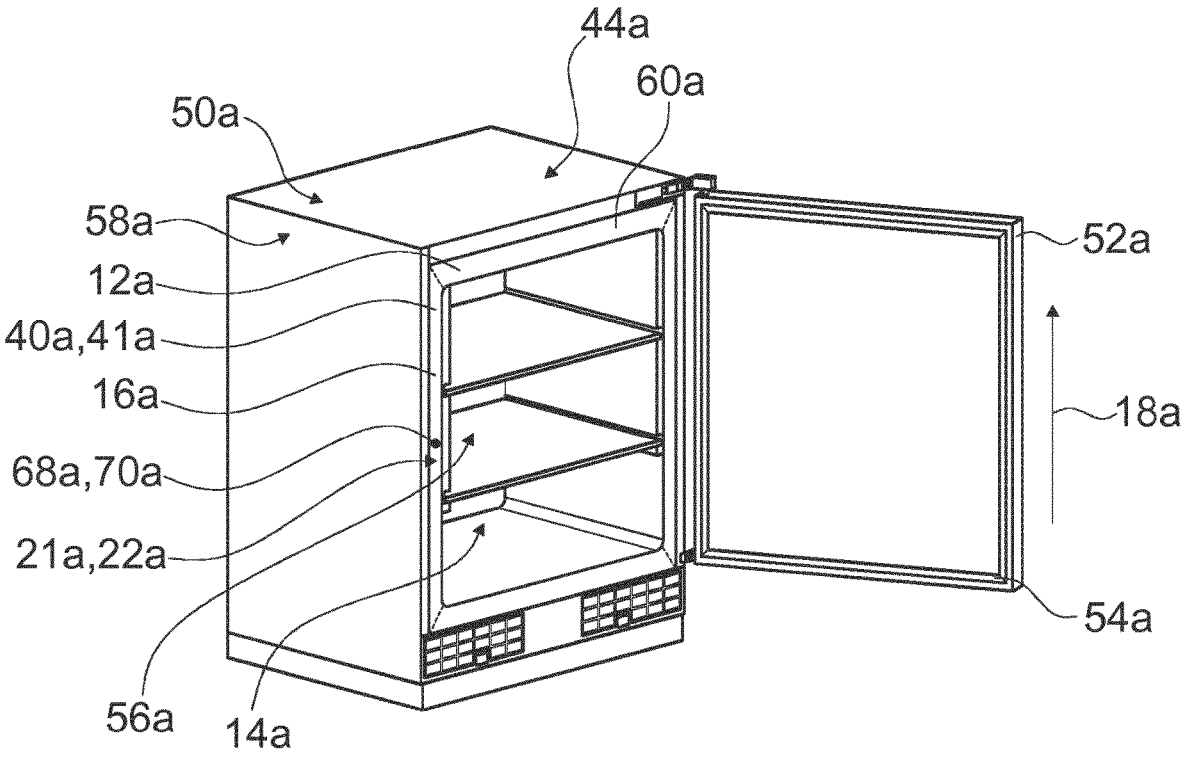
FIG. 1 shows a domestic refrigeration appliance having a domestic refrigeration appliance device and a frame unit.

FIG. 1 shows a domestic refrigeration appliance 44*a* according to a first exemplary embodiment. The domestic refrigeration appliance 44*a* is embodied as a domestic freezer appliance. In the present case the domestic refrigeration appliance 44*a* is embodied as an upright freezer. The domestic refrigeration appliance 44*a* has an internal temperature of up to −18° C.

Furthermore, the domestic refrigeration appliance 44*a* has a domestic refrigeration appliance device. The domestic refrigeration appliance device comprises an appliance closure element 52*a*. In the present case the appliance closure element 52*a* is embodied as an appliance door. The appliance closure element 52*a* has an appliance closure sealing element 54*a*. The appliance closure sealing element 54*a* is embodied as a door seal. The domestic refrigeration appliance device further comprises an appliance body 50*a*. The appliance body 50*a* comprises an inner container 60*a*. The inner container 60*a* consists of a thermoelastic plastic. The inner container 60*a* delimits a usable space 56*a*. In an assembled state the usable space 56*a* has an access opening 14*a* on a side facing the appliance sealing element 52*a*. The access opening 14*a* is provided to remove and/or introduce refrigerated goods out of and/or into the usable space 56*a*. An operating temperature of below 0° C. prevails within the usable space 56*a*. Furthermore, an operating temperature in the range of −20° C. to 0° C. can prevail within the usable space 56*a*. Alternatively, it would be conceivable for an appliance body to have two or more usable spaces. Similarly conceivable is an embodiment of the domestic refrigeration appliance device which comprises at least two appliance closure elements, wherein the appliance closure elements can be arranged in particular one above the other and/or adjacent to one another.

Furthermore, the domestic refrigeration appliance device has a frame unit 12*a*. The frame unit 12*a* delimits the access opening 14*a*. In the present case the frame unit 12*a* encompasses the access opening 14*a* completely. Alternatively, it is conceivable that a frame unit only partially encompasses an access opening. The frame unit 12*a* consists of a thermoelastic plastic. The frame unit 12*a* is embodied in one piece with the inner container 60*a*. In the present case the frame unit 12*a* and the inner container 60*a* consist of the same material. Alternatively, it is conceivable that a frame unit and an inner container consist of different materials. Furthermore, the frame unit 12*a* has at least one frame sub-element 16*a*. The frame sub-element 16*a* partially delimits the access opening 14*a*. The frame sub-element 16*a* is embodied in one piece with the inner container 60*a*. Alternatively, the domestic refrigeration appliance device can have a number of frame sub-elements. In particular, it is conceivable to form a frame sub-element from a material which differs at least partially from a material of a frame unit and/or an inner container.

Figure 2:
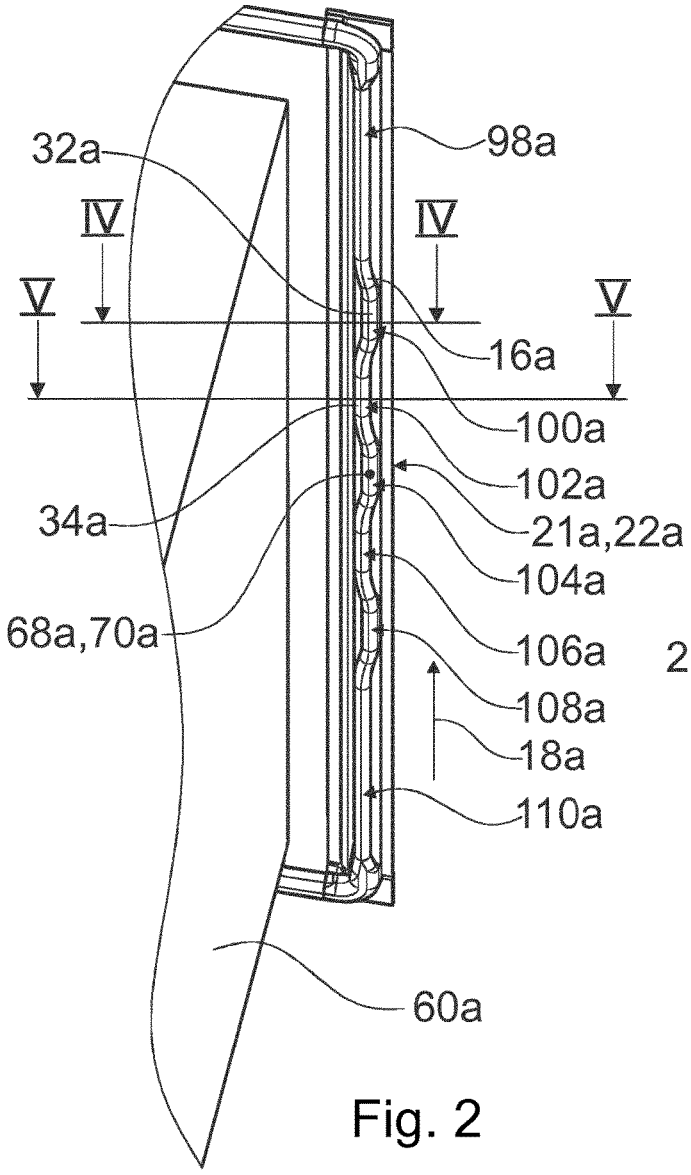
FIG. 2 shows a frame sub-element of the frame unit.
Figure 3:
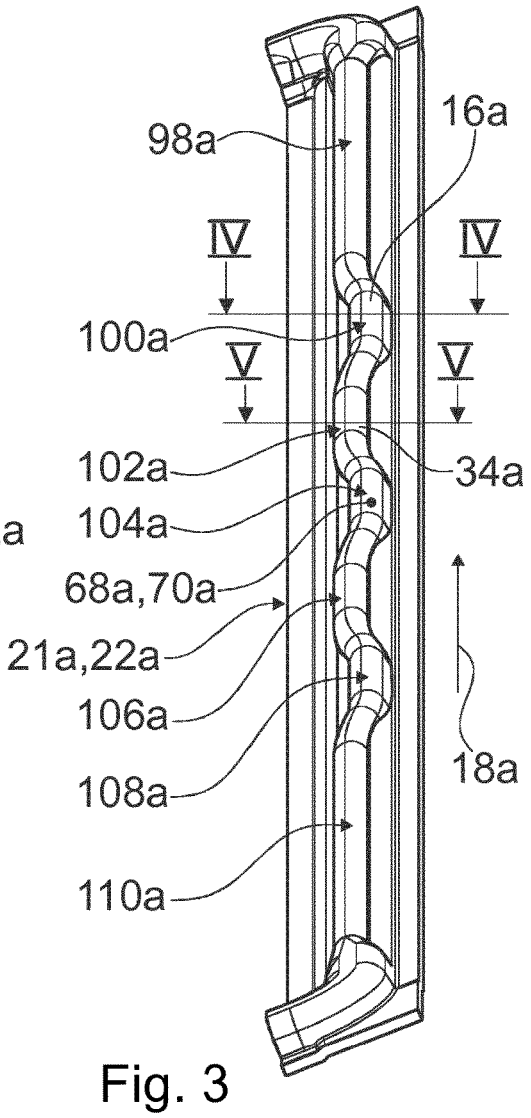
FIG. 3 shows the frame sub-element in an enlarged view.

FIGS. 2 and 3 show a cut-out of the domestic refrigeration appliance device with the frame sub-element 16*a*. The frame sub-element 16*a* has a main direction of extension 18*a*, which is arranged parallel to a main direction of extension of the appliance body 50*a*. The frame sub-element 16*a* further has a groove 20*a* running substantially parallel to the main direction of extension 18*a* (cf. FIGS. 4 and 5).

Figure 4:
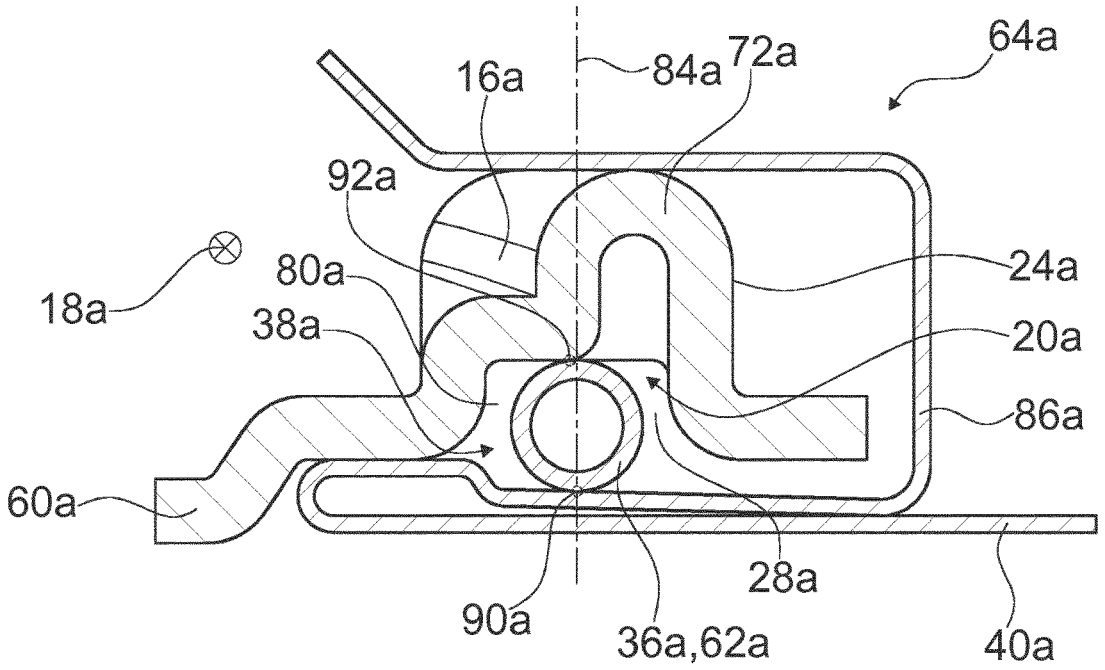
FIG. 4 shows a first cross-section of the frame sub-element having a fixing unit and a heating element in a schematic sectional view along line IV-IV in FIG. 2.
Figure 5:
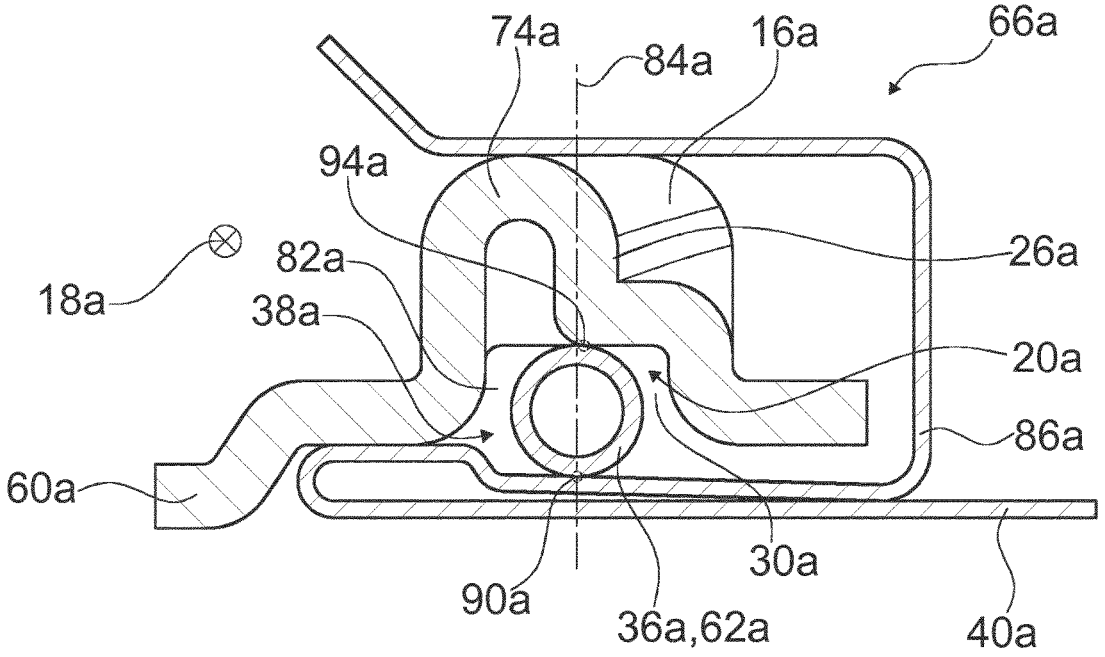
FIG. 5 shows a second cross-section of the frame sub-element with the fixing unit and the heating element in a schematic sectional view along line V-V in FIG. 2

Furthermore, the domestic refrigeration appliance device has a heating element 36*a* (cf. FIGS. 4 and 5). The heating element 36*a* is embodied to be oblong. The heating element 36*a* is embodied to be curved. The heating element 36*a* extends in parallel to the main direction of extension 18*a*. The heating element 36*a* is arranged within the groove 20*a* (cf. FIGS. 4 and 5). In the present case the heating element 36*a* is embodied as a hot gas pipe 62*a*. A diameter of the heating element 36*a* lies in the region between 3 mm and 5 mm.

The frame sub-element 16*a* is composed of a number of frame sub-element sections 98*a*, 100*a*, 102*a*, 104*a*, 106*a*, 108*a*, 110*a*. In the present case the frame sub-element 16*a* has a number of frame sub-element sections 98*a*, 100*a*, 102*a*, 104*a*, 106*a*, 108*a*, 110*a* displaced in particular in parallel to the main direction of extension of the frame sub-element sections. A first group of frame subsections 100*a*, 104*a*, 108*a* is arranged outwardly displaced in relation to the usable space 56 compared with a second group of frame sub-sections 98*a*, 102*a*, 106*a*, 110*a*. The frame sub-element sections 98*a*, 100*a*, 102*a*, 104*a*, 106*a*, 108*a*, 110*a* are arranged alternately. The frame sub-element sections 98*a*, 100*a*, 102*a*, 104*a*, 106*a*, 108*a*, 110*a* are arranged periodically oscillating. Furthermore, the frame sub-element sections 98*a*, 100*a*, 102*a*, 104*a*, 106*a*, 108*a*, 110*a* merge constantly into one another. In the present case the frame sub-element 16*a* is configured to be wavy. Alternatively, frame subsections can be configured to be rectangular, triangular and/or sawtooth-shaped and/or merge into one another.

A central region 22*a* of the frame sub-element sections 98*a*, 100*a*, 102*a*, 104*a*, 106*a*, 108*a*, 110*a* forms a subregion 21*a* of the frame sub-element 16*a*. The subregion 21*a* corresponds to at least 50% of the frame sub-element 16*a*. The subregion 21*a* corresponds accordingly to a central region 22*a* of the frame sub-element 16*a*. Alternatively, a subregion can also comprise more or less than 50% of a frame sub-element. In the present case a geometric center point 68*a* of the subregion 21*a* is identical to a geometric center point 70*a* of the frame sub-element 16*a*. Moreover, the frame sub-element 16*a* has two cross-sectional shapes 24*a*, 26*a* which differ substantially from one another in the subregion 21*a* in relation to the main direction of extension 18*a*. FIGS. 4 and 5 show cross-sections 64*a*, 66*a* of the frame sub-element 16*a* along lines IV-IV and V-V in FIG. 2. FIG. 4 shows a cross-section through a frame sub-element section 100*a* of the first group of frame subsections 100*a*, 104*a*, 108*a*, while FIG. 5 shows a sectional view through a frame sub-element section 102*a* of the second group of frame subsections 98*a*, 102*a*, 106*a*, 110*a*. The cross-sections 64*a*, 66*a* here show the different cross-sectional shapes 24*a*, 26*a*. Here the cross-sections 64*a*, 66*a* have two different groove cross-sections 28*a*, 30*a*.

The cross-sectional shapes 24*a*, 26*a* are embodied substantially differently from one another. The cross-sectional shapes 24*a*, 26*a* are embodied such that the surfaces 72*a*, 74*a* of the cross-sectional shapes 24*a*, 26*a*, projected onto a plane, which runs at right angles to the main direction of extension 18*a*, have a shared sectional surface of at most 75%. The cross-sectional shapes 24*a*, 26*a* delimit the groove cross-sections 28*a*, 30*a*. The groove cross-sections 28*a*, 30*a* are embodied displaced at different positions 32*a*, 34*a* along the main direction of extension 18*a*. The groove cross-sections 28*a*, 30*a* have a distance which corresponds at most to 10% of the main extension of the frame sub-element 16*a*. The groove cross-sections 28*a*, 30*a* have substantially an identical shape. The groove cross-sections 28*a*, 30*a* delimit surfaces 80*a*, 82*a* of the same size. The groove cross-sections 28*a*, 30*a* also have a shared mirror plane 84*a*. The groove cross-sections 28*a*, 30*a* can be merged into one another with the aid of the mirror plane 84*a*. Alternatively it is conceivable that a distance of groove cross-sections corresponds at most to 1% and/or at most to 5% of a main extension of a frame sub-element.

The domestic refrigeration appliance device further comprises a fixing unit 38*a*. In the present case the frame sub-element 16*a* forms one part of the fixing unit 38*a*. Moreover, the fixing unit 38*a* comprises a screen unit 40*a*. The screen unit 40*a* is formed from sheet metal. The screen unit 40*a* has a sealing element contact surface 41*a*. The sealing element contact surface 41*a* serves as a contact surface for the appliance closure sealing element 54*a*. The sealing element contact surface 41*a* indirectly covers the groove 20*a*.

The fixing unit 38*a* moreover has a frame strap 86*a*. The frame strap 86*a* is embodied in one piece with the sealing element contact surface 41*a*. The frame strap 86*a* encompasses the frame sub-element 16*a* at least partially. The frame strap 86*a* is embodied at least substantially in a u-shape viewed in the cross-section. The frame strap 86*a* surrounds the groove 20*a*. Furthermore the frame strap 86*a* surrounds the groove 20*a* at least substantially in a foam-tight manner. The frame strap 86*a* directly covers the groove 20*a*.

A projection of the heating element 36*a* and the fixing unit 38*a* on a plane at right angles to the main direction of extension 18*a* displays three fixing regions 90*a*, 92*a*, 94*a* between the heating element 36*a* and the fixing unit 38*a*. The fixing unit 38*a* secures the heating element 36*a* with force and/or form-locking using the fixing regions 90*a*, 92*a*, 94*a* in particular by means of the geometrical embodiment and developing frictional forces.

The cross-sectional shapes 24*a*, 26*a* and the groove cross-sections 28*a*, 30*a* are arranged alternately in relation to the main direction of extension 18*a* and in particular similarly to the frame sub-element sections 98*a*, 100*a*, 102*a*, 104*a*, 106*a*, 108*a*, 110*a* at least in sections. The frame sub-element 16*a* is thus composed of sections with different cross-sectional shapes 24*a*, 26*a*. The groove 20*a* is composed of sections with different groove cross-sections 28*a*, 30*a*. The cross-sectional shapes 24*a*, 26*a* and groove cross-sections 28*a*, 30*a* are also arranged periodically oscillating in relation to the main direction of extension 18*a* at least in sections. The cross-sectional shapes 24*a*, 26*a* and the groove cross-sections 28*a*, 30*a* merge constantly into one another. The groove 20*a* and its sections are configured in a wavy sinusoidal manner when viewed in the main direction of extension 18*a*. Alternatively, sections of cross-sectional shapes and/or groove cross-sections can be configured in an angular, rectangular, triangular and/or sawtooth manner and/or merge into one another.

In the present case the heating means 36*a* is operated using the waste heat from a compressor. The heating element 36*a* is provided to supply heat energy to the appliance body 50*a*, the frame unit 12*a*, the frame sub-element 16*a*, the fixing unit 38*a*, the screen unit 40*a*, the frame strap 86*a*, the sealing element contact surface 41*a*, the appliance closure element 52*a* and/or the appliance closure sealing element 54*a*. In this way the heating element 36*a* counteracts an icing, particularly due to condensing water, of the frame unit 12*a* and/or of the appliance closure element 52*a* and/or the sealing element contact surface 41*a* and/or of the appliance closure sealing element 54*a*, so that a simple and in particular non-destructive opening of the appliance closure element is ensured.

Alternatively a heating element can also be operated using warmer external air in relation to the air in an inner container. It is also conceivable that a heating element uses a refrigerant to transport and/or exchange heat energy.

Figure 6:
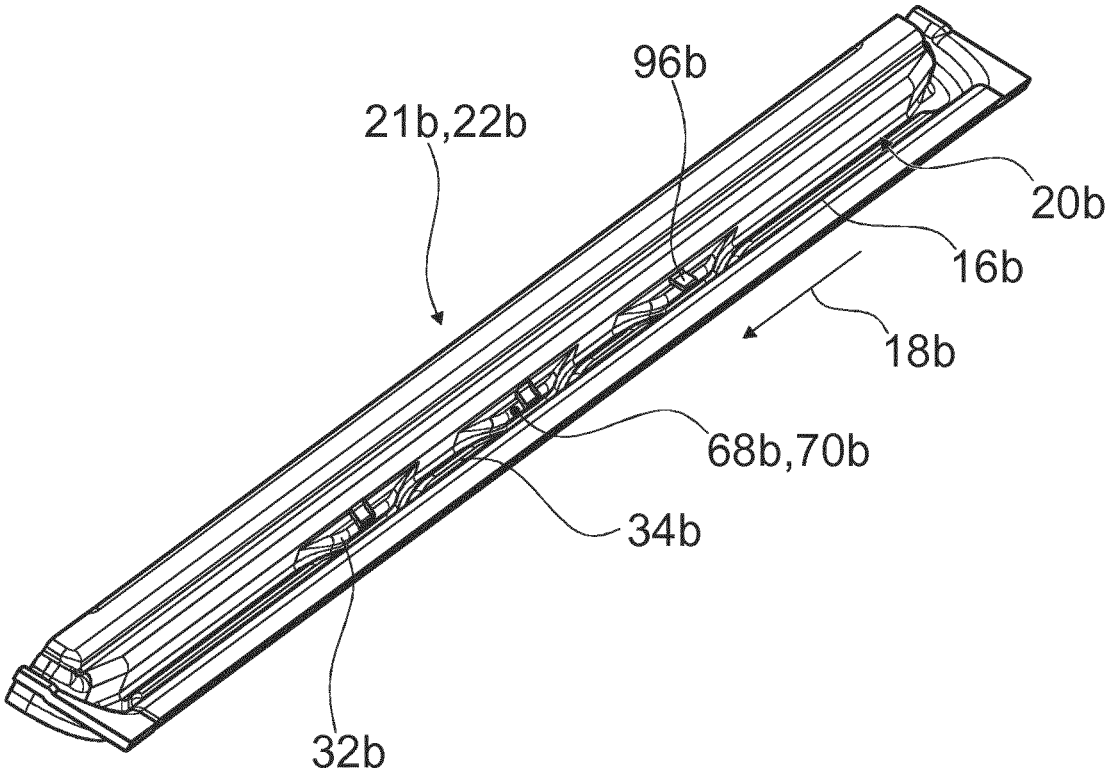
FIG. 6 shows a frame sub-element of a frame unit of a further domestic refrigeration appliance device.

A further exemplary embodiment of the invention is shown in FIG. 6. The descriptions below are restricted substantially to the differences between the exemplary embodiments. Reference can basically also be made to the drawings and/or the description of the exemplary embodiment in FIGS. 1 to 5, in respect of components labeled the same, in particular in respect of components with identical reference characters. To differentiate between exemplary embodiments the letter a is placed after the reference characters of the exemplary embodiment in FIGS. 1 to 5. In the exemplary embodiment in FIG. 6, the letter a is replaced by the letter b. The further exemplary embodiment in FIG. 6 differs from the previous exemplary embodiment at least substantially by a frame sub-element 16*b* of a frame unit 12*b*.

FIG. 6 shows the frame sub-element 16*b*. The domestic refrigeration appliance device comprises at least one support element 96*b*. In the present case the domestic refrigeration appliance device comprises three support elements 96*b*. Alternatively, a domestic refrigeration appliance device can also have any number of other support elements, such as, for instance, at least two, at least three and/or at least four support elements. The support elements 96*b* consist of a thermoelastic plastic. The support elements 96*b* and the frame sub-element 16*b* are formed from the same material. In the present case the support elements 96*b* are connected in one piece with the frame sub-element 16*b*. The support elements 96*b* are arranged within the groove 20*b*. In an assembled state the heating element 36*a* rests against the support elements 96*b*. The support elements 96*b* form additional supporting surfaces for the heating element 36*a*.

REFERENCE CHARACTERS

12 Frame unit
14 Access opening
16 Frame sub-element
18 Main direction of extension
20 Groove
21 Subregion
22 Central region
24 Cross-sectional shape
26 Cross-sectional shape
28 Groove cross-section
30 Groove cross-section
32 Position
34 Position
36 Heating element
38 Fixing unit
40 Screen unit
41 Sealing element contact surface
44 Domestic refrigeration appliance
50 Appliance body
52 Appliance closure element
54 Appliance closure sealing element
56 Usable space
60 Inner container
62 Hot gas pipe
64 Cross-section
66 Cross-section
68 Geometric center point of the subregion
70 Geometric center point of the frame sub-element
72 Surface of the cross-sectional shape
74 Surface of the cross-sectional shape
80 Surface of the groove cross-section
82 Surface of the groove cross-section
84 Mirror plane
86 Frame strap
90 Fixing region
92 Fixing region
94 Fixing region
96 Support element
98 Frame sub-element section
100 Frame sub-element section
102 Frame sub-element section
104 Frame sub-element section
106 Frame sub-element section
108 Frame sub-element section
110 Frame sub-element section

The invention claimed is:

1. A domestic refrigeration or freezer appliance device, comprising:

a frame unit at least partially delimiting an access opening, said frame unit including at least one frame sub-element;

said at least one frame sub-element having a main direction of extension and a subregion;

said at least one frame sub-element having at least one groove running at least substantially parallel to said main direction of extension; and said at least one frame sub-element having two cross-sectional shapes being different from one another in said subregion relative to said main direction of extension;

said at least one groove having a first groove cross-section being delimited by a first stepped sidewall and a second groove cross-section being delimited by a second stepped sidewall on an opposite longitudinal side of said groove from said first stepped sidewall, said first and second stepped sidewalls each defining a respective step at middle regions of said first and second sidewalls.

2. The domestic refrigeration appliance device according to claim 1, which further comprises a substantially oblong heating element, disposed at said at least one groove for at least partially counteracting an icing of said frame unit.

3. The domestic refrigeration appliance device according to claim 1, which further comprises a fixing unit including said frame sub-element and at least one cover at least partially covering said at least one groove.

4. The domestic refrigeration appliance device according to claim 1, wherein said cross-sectional shapes are disposed alternately at least in sections relative to said main direction of extension.

5. A domestic refrigeration or freezer appliance device, comprising:

a frame unit at least partially delimiting an access opening, said frame unit including at least one frame sub-element;

said at least one frame sub-element having a main direction of extension and a subregion;

said at least one frame sub-element having at least one groove running at least substantially parallel to said main direction of extension; and said at least one frame sub-element having at least two cross-sectional shapes being different from one another in said subregion relative to said main direction of extension;

said cross-sectional shapes periodically oscillate at least in sections relative to said main direction of extension, said cross-sectional shapes having a same length as one another in said main direction of extension.

6. The domestic refrigeration appliance device according to claim 1, wherein said cross-sectional shapes continuously merge into one another at least in sections.

7. The domestic refrigeration appliance device according to claim 1, wherein said frame sub-element has at least one of an at least substantially curved or angular structure at least in sections, in said main direction of extension.

8. The domestic refrigeration appliance device according to claim 2, which further comprises at least one support element configured to rest against said heating element.

9. A domestic refrigeration or freezer appliance, comprising a domestic refrigeration or freezer appliance device according to claim 1.

10. A method for manufacturing a domestic refrigeration or freezer appliance device, the method comprising the following steps:

providing a frame unit delimiting an access opening;

providing the frame unit with at least one frame sub-element having a main direction of extension and a subregion;

introducing at least one groove into the frame sub-element, the at least one groove running at least substantially parallel to the main direction of extension; and providing the frame sub-element with two cross-sectional shapes differing substantially from one another in the subregion relative to the main direction of extension, the at least one groove having a first groove cross-section delimited by a first stepped sidewall and a second groove cross-section delimited by a second stepped sidewall on an opposite longitudinal side of the groove from the first stepped sidewall, the first and second stepped sidewalls each defining a respective step at middle regions of the first and second sidewalls.

11. The domestic refrigeration appliance device according to claim 3, wherein said at least one groove has a groove bottom defining a depth of said at least one groove along a longitudinal extent thereof and a groove opening opposite said groove bottom, said at least one cover at least partially covering said groove opening.

12. The domestic refrigeration appliance device according to claim 11, wherein said groove bottom and said at least one cover define opposing fixing regions.

13. A domestic refrigeration or freezer appliance device, comprising:

a frame unit at least partially delimiting an access opening, said frame unit including at least one frame sub-element;

said at least one frame sub-element having a main direction of extension and a subregion;

said at least one frame sub-element having at least one groove running at least substantially parallel to said main direction of extension; and said at least one frame sub-element having two cross-sectional shapes at respective positions along said main direction of extension, said two cross-sectional shapes differing substantially from one another in said subregion relative to said main direction of extension, each of said cross-sectional shapes being individually asymmetrical along a respective length of thereof with respect to a shared mirror plane extending along said main direction of extension, said cross-sectional shapes periodically oscillate at least in sections relative to said main direction of extension.

14. The domestic refrigeration appliance device according to claim 13, wherein said cross-sectional shapes have an equal extent as one another in said main direction of extension.

* * * * *